United States Patent [19]

Dvirka

[11] 4,110,999

[45] Sep. 5, 1978

[54] SPRAY COOLING TEMPERATURE CONTROL SYSTEM

[76] Inventor: Miro Dvirka, 12 Hamilton Pl., Garden City, N.Y. 11530

[21] Appl. No.: 794,092

[22] Filed: May 5, 1977

[51] Int. Cl.[2] ..... F28D 3/00

[52] U.S. Cl. ..... 62/171

[58] Field of Search ..... 62/171, 91; 239/563; 261/39 R, 41 R, 66, 67

[56] References Cited

U.S. PATENT DOCUMENTS

| | | | |
|---|---|---|---|
| 2,515,301 | 7/1950 | Hughey | 239/563 X |
| 3,842,615 | 10/1974 | Reigel et al. | 62/171 |

*Primary Examiner*—William E. Wayner

*Attorney, Agent, or Firm*—Mason, Fenwick & Lawrence

[57] ABSTRACT

An evaporative spray cooling system for cooling an effluent gas is disclosed including a pressurized supply of coolant fluid, a hydraulic cylinder manifold having a movable piston, individual spray nozzles communicating with ports spaced apart along the length of the hydraulic cylinder manifold, a hydraulic cylinder actuator having a movable piston operatively connected to the piston of the hydraulic cylinder manifold, said pressurized fluid supply communicating with one end of said hydraulic cylinder manifold to supply coolant fluid to the manifold, valve means for selectively supplying the pressurized fluid to one side of the hydraulic cylinder actuator piston for overcoming the supply fluid force on the hydraulic cylinder manifold piston to move the manifold piston in first one direction in response to an increase in effluent gas temperature above a predetermined temperature thereby opening more spray nozzles to decrease the temperature of the effluent gas and decreasing the pressure of the supply fluid on said one side of said actuator piston to permit the manifold piston to move in the opposite direction as the temperature of the effluent gas decreases below the predetermined temperature thereby closing additional spray nozzles and permitting the temperature of the effluent gas to rise.

9 Claims, 1 Drawing Figure

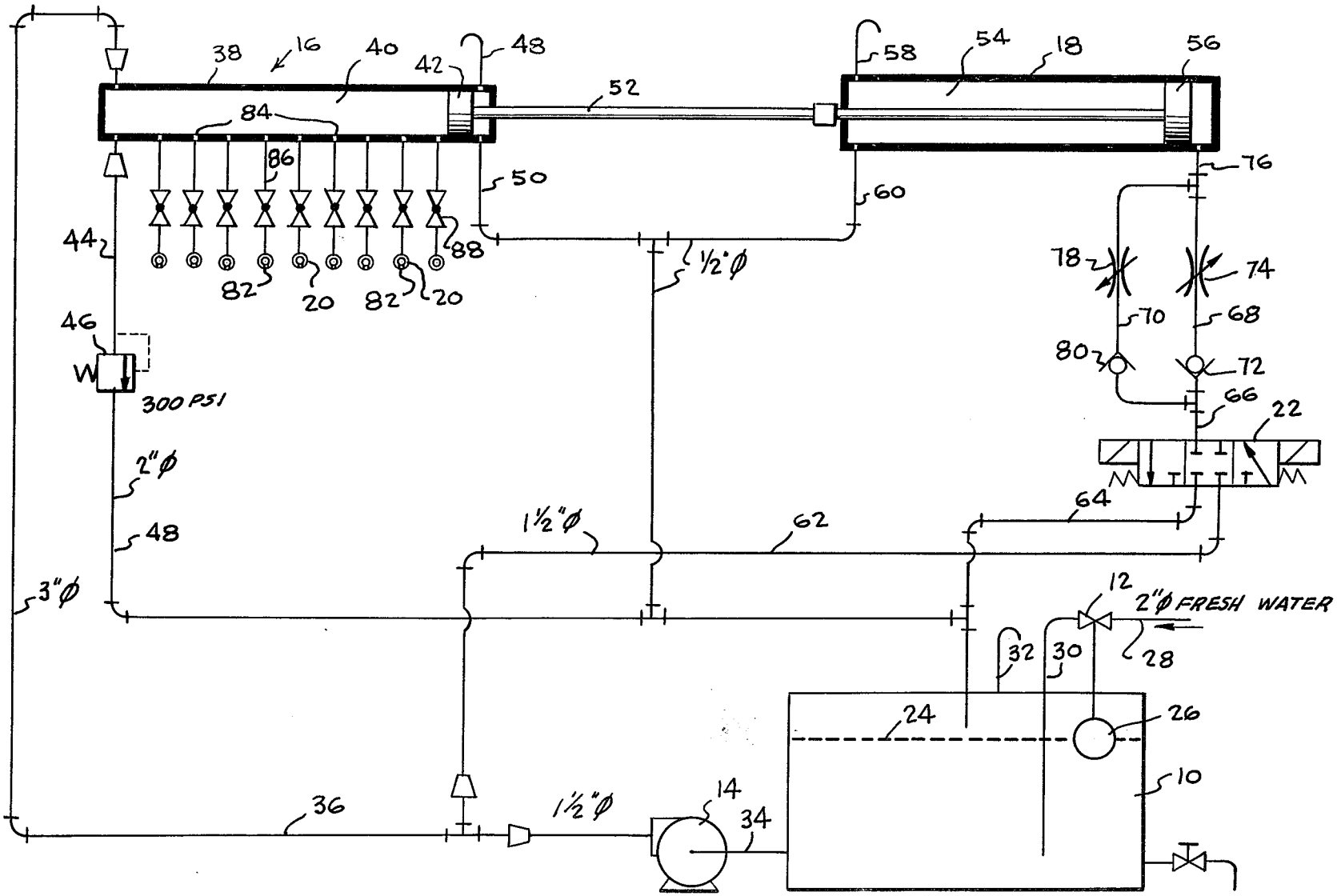
2"Ø FRESH WATER
300 PSI
1½"Ø
2"Ø
3"Ø

SPRAY COOLING TEMPERATURE CONTROL SYSTEM

This invention relates to evaporative spray cooling systems for achieving a desired effluent fluid temperature where the effluent fluid entering the system has a variable temperature and/or flow rate. The invention is more particularly directed to evaporative spray cooling systems in which a coolant fluid is sequentially supplied to spaced apart nozzles to provide a desired degree of cooling to the effluent fluid thereby permitting control of the effluent fluid at a predetermined desired temperature.

With dry dust collection systems such as precipitators, cyclones or bag houses, the effluent fluid or flue gas temperature is frequently so high that it will damage the dust collection system and therefore must be reduced to achieve the desired results without causing damage to the system. Simply reducing the temperature of the effluent fluid is not sufficient if the cooling fluid, which is usually water, is not completely evaporated. The carry over of droplets into the dust collection system will cause conglomeration of the dust particles and clogging of the collection system due to the adherence of wet dust to the walls, hoppers and other components of the dust collectors. Additionally, depending on the composition of the effluent fluid, chemical corrosion of the system components may be caused by the accumulation of coolant fluid through the formation of acids and the like. Presently known evaporative spray cooling systems provide small fluid droplets with their maximum size being determined by the system pressure and the flow capabilities of the particular nozzles which are being used. When the system pressure is varied to control the rate of flow of coolant fluid through a nozzle or group of nozzles there will be a significant variation in the size of the droplets.

To overcome the inherent difficulties in achieving complete evaporation when the size of the droplets from the nozzles vary, previously known spray cooling temperature control systems have used a multitude of nozzles controlled by automatic or manual valves, either individually or in banks, with the supply fluid being provided from a constant pressure source to achieve uniform droplet size from the nozzles. The flow of cooling fluid has been controlled by opening successively additional nozzles or closing additional nozzles to control the effluent temperature at the desired temperature. When the effluent temperature control is critical or where the temperature of the effluent fluid or mass flow varies considerably during operation of the system, the valve and control systems necessary to produce the desired temperature control become quite elaborate which is detrimental to the reliability of the system and excessively increases the maintenance costs.

Accordingly, it is the principal object of the present invention to provide a novel evaporative spray cooling system for effluent fluids.

Another object of the present invention is to provide an automatic evaporative spray cooling system which is capable of controlling the temperature of the effluent fluid at a predetermined temperature over a wide range of temperature fluctuation and mass flow rate changes for the effluent fluid entering the system.

A further object of the present invention is to provide an evaporative spray cooling system which provides a high degree of reliability and reduces maintenance costs.

A still further object of the present invention is to provide a novel evaporative spray cooling system which sequentially supplies a constant pressure coolant fluid to as many spray nozzles as necessary to achieve the desired cooling of the effluent fluid.

A still further object of the present invention is to provide a novel evaporative spray cooling system which provides a step control addition or subtraction of nozzles supplied with the coolant fluid to approach the performance of a modulating volume control system.

Other objects and advantages of the present invention will become apparent to those persons having ordinary skill in the art to which the invention pertains, from the following description taken in conjunction with the accompanying drawing which is a schematic diagramatic view of an evaporative spray cooling system according to the present invention.

Referring to the drawing, there is illustrated an evaporative spray cooling system on which the present invention may be utilized. The evaporative spray cooling system includes a coolant fluid reservoir 10 supplied with fresh water through a float control valve 12, a supply pump 14, a hydraulic cylinder manifold 16, a hydraulic cylinder actuator 18, spray rings 20 which communicate with the hydraulic cylinder manifold 16, and a three-way three-position double solenoid valve 22.

The level of coolant water 24 in the reservoir 10 is maintained at a constant level by the float control valve 12 which has a float 26 extending to the water level 24 within the reservoir thereby adding fresh water as necessary to make up for coolant water as it is sprayed from ring 20. Fresh water being supplied to the valve 12 by inlet line 28 and from the valve 12 to the reservoir 10 by inlet pipe 30. The reservoir is vented to atmospheric pressure by vent pipe 32. The reservoir communicates with pump 14 through outlet line 34 with the pump 14 supplying coolant water to the manifold 16 through a manifold line 36.

The manifold 16 is a hydraulic cylinder which is represented as a closed ended tube 38 having a bore 40 and a close fitting piston 42 movable along the bore of the housing 38. Manifold line 36 opens directly into the interior of the bore 40. The bore 40 is communicated with the reservoir through a pressure relief line 44 having a pressure relief valve 46 which is adjusted to vent excess coolant fluid to the reservoir through line 48 when the coolant fluid pressure exceeds a desired preset pressure.

The opposite end of the manifold, behind the piston 42, is vented to atmospheric pressure through vent 48 on the top side of the housing 38 and is vented through a drain line 50 to the reservoir to return any coolant fluid, which may leak past the piston, to the reservoir 10. Movement of the piston 42 is accomplished through connecting rod 52 which operatively connects the manifold and the actuator. The hydraulic cylinder actuator 18 has a bore 54 which is of larger diameter than bore 40 in the manifold and has a close fitting piston 56 which is free to move back and forth in the bore 54. The actuator piston 56 and the manifold piston 40 are attached to opposite ends of the connecting rod 52. The actuator is vented at one end to atmosphere through a vent 58 with a drain line 60 returning any actuation fluid which leaks past the piston 56 to the reservoir 10 in a manner similar to the vent and drain on the manifold. The opposite end of the hydraulic cylinder actuator receives the pressurized coolant through actuation line 62 from the supply pump 14 through the solenoid valve 22. A drain line 64 extends from the solenoid valve 22 to the reservoir 10 while the valve communicates either the actuation line 62 or the drain line 64 with the bore 54 behind the actuation piston 56 through control line 66 having an actuation loop 68 in parallel with a drain loop 70. The actuation loop 68 has a one-way check valve 72 and a variable orifice 74 to control the direction and rate of movement of the piston 56 by controlling the rate of flow of pressurized fluid introduced into the actuator through inlet line 76 while the drain loop 70 has a similar variable orifice 78 and a one-way check valve 80 to permit control of the actuation fluid when it is returned to the reservoir through the drain line 64.

Spray rings 20 are of conventional configuration and include a ring of thin-walled tubing having inwardly directed nozzle openings 82 which are circumferentially spaced apart around the ring 20 to spray coolant water toward the center of the ring. Effluent fluids such as exhaust gases are caused to pass through the spray rings 20 thereby being cooled by the coolant fluid as it is sprayed into the effluent fluid from the spray rings 20. The coolant fluid enters the spray rings from the manifold 16 through outlet ports 84 which are spaced apart along the bore 40 of the manifold and are sequentially closed off as the piston 42 moves along the bore 40. Outlet ports 84 communicate with the spray rings 20 through spray lines 86 having manually operable valves 88 therein to permit closing off of desired spray rings for different applications or the adjustment of the spray characteristic of each spray ring as desired.

Actuation of the solenoid valve 22 is accomplished by a conventional temperature sensor control means which produces an actuation signal to the desired solenoid on the valve in response to the temperature of the effluent fluid being at, above or below the desired temperature. The solenoid valve is shown in the neutral position in the drawing which occurs when the effluent fluid is at the desired temperature. The valve is shifted to the left as shown in the drawing when the temperature is above the desired temperature and is shifted to the right when the temperature of the effluent gas is below desired temperature.

In the operation of the evaporative spray cooling system, water is supplied to the reservoir 10 until it fills to level 24 at which time the float 26 actuates shutoff valve 12. Feed pump 14 provides pressurized water to the manifold 16 through line 36 and the pressure of the coolant water is maintained at a desired pressure by relief valve 46 by dumping any excess water to the reservoir 10. Assuming the desired temperature of the effluent gas is to be reduced to 500° with an allowable range of 498° F. to 502° F., the effluent gas passing through the spray rings 20 will normally be at temperatures in excess of the 500° which will cause the temperature controller to activate the valve 22 and cause it to move to the right which will communicate the bore 54 behind the piston 56 with the reservoir 10 through the variable orifice 78 in drain line 70. The pressure of the coolant water in the bore 40 of the manifold 16 will cause the piston 42 to move to the right thereby opening as many outlet ports 84 as are necessary to decrease the temperature of the effluent gas to the desired 500°. At this point the temperature controller will cause the solenoid valve to move to the center or neutral position as shown thereby closing off the control line 66 and locking the actuator piston 56 in the desired position to maintain as many spray rings in operation as are necessary to cool the effluent gas the desired amount. If the temperature drops below 498° F. the solenoid valve will move to the left and communicate the bore 54 behind the piston 56 with the pressurized cooling water from actuation line 62 through one-way valve 72 and variable orifice 74 which will cause the piston 56 to move to the left thereby closing off additional outlet ports 84 and spray rings 20 to thereby decrease the quantity of cooling fluid being sprayed into the effluent gas. This will permit the temperature of the effluent gas to rise to the desired 500° at which temperature the temperature controller will cause the solenoid valve 22 to move to the center or neutral position and close off the control line 66 thereby locking the actuator in the desired position. Since the piston 56 is larger than the piston 42 and the pressure is the same on opposed ends of these two pistons, the larger area of the actuator piston 56 will cause the connecting rod 52 to move in the desired direction when fluid is supplied to the backside of piston 56. The vents 48 and 58 and the drains 50 and 60 on the manifold and actuators permit the system to operate in the desired fashion.

As can be readily noted the system according to the present invention automatically adds a coolant fluid to the effluent gases as necessary to maintain the temperature of the effluent gases within the desired range through the use of spray rings which are operated with a constant pressure coolant fluid thereby producing droplets which do not vary in size thereby providing a system with superior reliability and significantly decreased maintenance costs.

From the foregoing detailed description, it will be evident that there are a number of changes, adaptations and modifications of the present invention which come within the province of those skilled in the art. It is intended, however, that all such variations not departing from the spirit of the invention be considered as within the scope thereof and limited solely by the appended claims.

I claim:

1. An evaporative spray cooling system for cooling an effluent fluid comprising a means for providing a constant pressure supply of coolant fluid, a manifold having an elongated bore therein, a piston movable within said manifold bore, spray nozzles communicating with ports spaced along said manifold bore and opening into said manifold bore, an actuator operatively connected to the manifold piston, said pressurized fluid supply communicating with a first end of said manifold bore to supply coolant fluid to the manifold bore, temperature control means for selectively activating said actuator to permit the force of the supply fluid on the manifold piston to move the manifold piston toward the second end of the manifold bore in response to an increase in effluent fluid temperature above a predetermined temperature thereby opening additional ports to supply coolant fluid to additional spray nozzles to decrease the temperature of the gas, and for selectively activating said actuator to move the manifold piston in the opposite direction as the temperature of the effluent gas decreases below the predetermined temperature to close additional ports and spray nozzles and permit the temperature of the effluent gas to rise thereby providing automatic spray cooling by supplying constant pressure coolant to a sufficient number of spray nozzles to achieve the necessary cooling of the effluent fluid.

2. The evaporative spray cooling system of claim 1 wherein said actuator is a hydraulic cylinder having a piston operatively connected to the manifold piston and said temperature controller means selectively supplies pressurized coolant fluid to said actuator piston to move the manifold piston in the desired direction.

3. The evaporative spray cooling system of claim 2 additionally including a connecting rod with the actuator piston fastened at one end thereof and the manifold piston fastened to the other end thereof, said actuator piston has a larger diameter than said manifold piston, and said temperature controller means supplies pressurized coolant fluid to the back side of the actuator piston opposite the manifold piston to move the manifold piston toward said first end of said manifold bore and removes said pressurized coolant fluid from said actuator piston to permit the pressurized coolant fluid in said manifold bore to move said manifold piston toward said second end of said manifold bore.

4. The evaporative spray cooling system of claim 1 additionally including spray rings on which said spray nozzles are spaced apart around the inner circumference of said spray rings and said spray rings are spaced apart with the effluent fluid flowing through the centers of said spray rings.

5. The evaporative spray cooling system of claim 4 wherein said actuator is a hydraulic cylinder having a piston operatively connected to the manifold piston and said temperature controller means selectively supplies pressurized coolant fluid to said actuator piston to move the manifold piston in the desired direction.

6. The evaporative spray cooling system of claim 5 additionally including a connecting rod with the actuator piston fastened at one end thereof and the manifold piston fastened at the other end thereof, said actuator piston has a larger diameter than said manifold piston, and said temperature controller means supplies pressurized coolant fluid to the back side of the actuator piston opposite the manifold piston to move the manifold piston toward said first end of said manifold bore and removes said pressurized coolant fluid from said actuator piston to permit the pressurized coolant fluid in said manifold bore to move said manifold piston toward said second end of said manifold bore.

7. The evaporative spray cooling system of claim 3 wherein the temperature control means includes a sump, a solenoid valve communicating with said sump and said coolant fluid supply, a control passageway communicating said valve with said back side of said actuator piston, said control passageway being bifurcated, a first and a second variable orifice respectively positioned in each of the bifurcated portions of the control passageway, and a first and second check valve respectively positioned in each of the bifurcated portions of the control passageway with the check valves opening in opposite directions thereby providing a means for controlling the speed of the actuator piston and the manifold piston.

8. The evaporative spray cooling system of claim 7 wherein the solenoid valve is a three-way, three position double solenoid valve.

9. The evaporative spray cooling system of claim 8 additionally including spray rings on which said spray nozzles are spaced apart around the inner circumference of said soray rings and said spray rings are spaced apart with the effluent fluid flowing through the centers of said spray rings.

* * * * *